United States Patent [19]

Denlinger et al.

[11] Patent Number: 4,676,575

[45] Date of Patent: Jun. 30, 1987

[54] SEALING MEMBER FOR BULKHEAD CONNECTOR

[75] Inventors: Keith R. Denlinger, Lancaster; John R. Shuey, Mechanicsburg, both of Pa.

[73] Assignee: AMP Incorporated, Harrisburg, Pa.

[21] Appl. No.: 876,159

[22] Filed: Jun. 19, 1986

[51] Int. Cl.[4] ..... H01R 13/74

[52] U.S. Cl. ..... 439/271; 439/559

[58] Field of Search ..... 339/17 LC, 220 R, 221 R, 339/221 M, 217 S, 252 R, 258 P, 94 R, 94 A, 94 C, 94 M, 206 R, 206 P, 207 R, 207 S, 126 R, 126 RS, 132 R, 132 B, 93 R, 93 C, 176 M, 92 R, 92 M, 65

[56] References Cited

U.S. PATENT DOCUMENTS

| | | | |
|---|---|---|---|
| 3,022,484 | 2/1962 | Thompson, Jr. | 339/94 M |
| 3,067,974 | 12/1962 | Baldwin | 339/126 RS |
| 3,376,539 | 4/1968 | Robinson et al. | 339/126 R |
| 4,447,103 | 5/1984 | Werth et al. | 339/94 M |
| 4,484,021 | 11/1984 | Schaefer et al. | 339/94 A |
| 4,611,872 | 9/1986 | Ito et al. | 339/94 M |

FOREIGN PATENT DOCUMENTS

| | | | |
|---|---|---|---|
| 1314138 | 11/1962 | France | 339/94 M |
| 2075766 | 11/1981 | United Kingdom | 339/94 M |

*Primary Examiner*—John McQuade

*Attorney, Agent, or Firm*—Anton P. Ness

[57] ABSTRACT

An integral elastomeric sealing member for an electrical connector assembly mountable to a panel has a transverse gasket section and an axial seal section extending rearwardly from an aperture through the gasket section. The gasket section is compressed between a mounting face of the receptacle and the panel, and the axial seal section extends along the inside of the plug-receiving cavity thereof and has an inner dimension just less than the outer dimension of the plug section of the plug connector which it seals around when the plug is in mating engagement with the receptacle. A tapered portion around the plug section acts as a camming surface to gently deform the axial seal section outwardly against the cavity wall, while the gasket section is held firmly between the panel and the receptacle connector.

18 Claims, 6 Drawing Figures

10
18
14
20
12
16

70
74
76
78
82
72
80
24
22
26
IA
30
38
42
32
40
36
34
64

70
74
78
72
10
16
18
34
82
80
48
30
74
78
60
64
102
108
106
104
116
100
104
106
108

SEALING MEMBER FOR BULKHEAD CONNECTOR

FIELD OF THE INVENTION

The present invention relates to electrical connectors and more particularly to sealing members for connectors mounted to bulkheads.

BACKGROUND OF THE INVENTION

In certain electrical connector assemblies mountable to a panel, and comprising a plug connector and a receptacle connector, the receptacle connector is first securely mounted to the panel with the receptacle plug-receiving cavity axially aligned with an aperture through the panel. Such an arrangement is common in connector assemblies for automotive controls where the controls must be assembled in a sealed "black box" which is mounted to the engine, and where the panel is a wall of the "box". The plug connector is later mated through the aperture with the now-remote receptacle connector and secured to the panel or bulkhead and receptacle connector such as by screws.

Such a connector assembly must be sealed to protect the contact terminals from dust, debris, humidity and other forms of contamination, and O-rings are known which are either placed around the outside of the forward portion of the plug and tightly engage the inside surface of the receptacle cavity, or are seated with the receptacle cavity and tightly engage the plug's forward portion, forming a seal. Such O-rings must be secured to the respective connector housing by being seated in a groove, or bonded to the housing or preferably both to prevent being dislodged and "rolled over" during connector mating and thus not sealing properly.

Also, it is necessary to provide a gasket between a front surface of the receptacle connector housing and the bulkhead peripherally around the aperture. Such a gasket provides sealing of the receptacle cavity from the engine environment.

It is desirable to reduce the total number of parts needed in a mounted receptacle connector. It is also desirable to simplify the manufacturing of the receptacle connector.

It is further desirable to provide an assured seal between the plug and connector when mated to protect the cavity in which the electrical contacts are disposed in electrical engagement with each other.

SUMMARY OF THE INVENTION

The present invention is an integral gasket seal of elastomeric material for a panel-mounted receptacle connector, having a transverse gasket section with an aperture and an axial seal section extending rearwardly from the transverse gasket section around the periphery of the aperture. The integral gasket seal is disposed at the front or mounting face of the receptacle housing such that the transverse gasket section is between the panel and the housing and the axial seal section is within the front of the plug-receiving cavity of the receptacle and along the inside wall surface.

When the receptacle connector is mounted to a panel such as a bulkhead, such as by the use of self-tapping screws, the transverse gasket section is compressed into a tight sealing fit between the bulkhead and the front of the receptacle housing. When the plug connector is mated into the receptacle connector via the bulkhead aperture, outside surfaces of the plug housing entering the receptacle cavity bear against the inwardly facing surface of the axial seal section of the integral gasket seal, and deform it into a tight sealing fit. The gasket section trapped between the bulkhead and the receptacle holds the axial seal section at the front of the receptacle to resist the axially rearward force exerted on the inside seal surface by the plug housing surface. This makes unnecessary a bonding of the seal within the receptacle and eliminates the possibility of "roll-over" or improper sealing between the plug and receptacle.

An objective of the present invention is to reduce the number of elastomeric members needed with the connector assembly. Another objective is to simplify the manufacturing of the receptacle by eliminating the need to locate a seal within the receptacle cavity and the further need to bond or secure such a seal therein.

BRIEF DESCRIPTION OF THE DRAWINGS

FIGS. 3 to 5 are longitudinal section views showing the mating of the receptacle and plug connectors, and showing the deforming of the gasket seal to seal around the plug.

DETAILED DESCRIPTION OF THE PREFERRED EMBODIMENT

Figures 1, 1A:
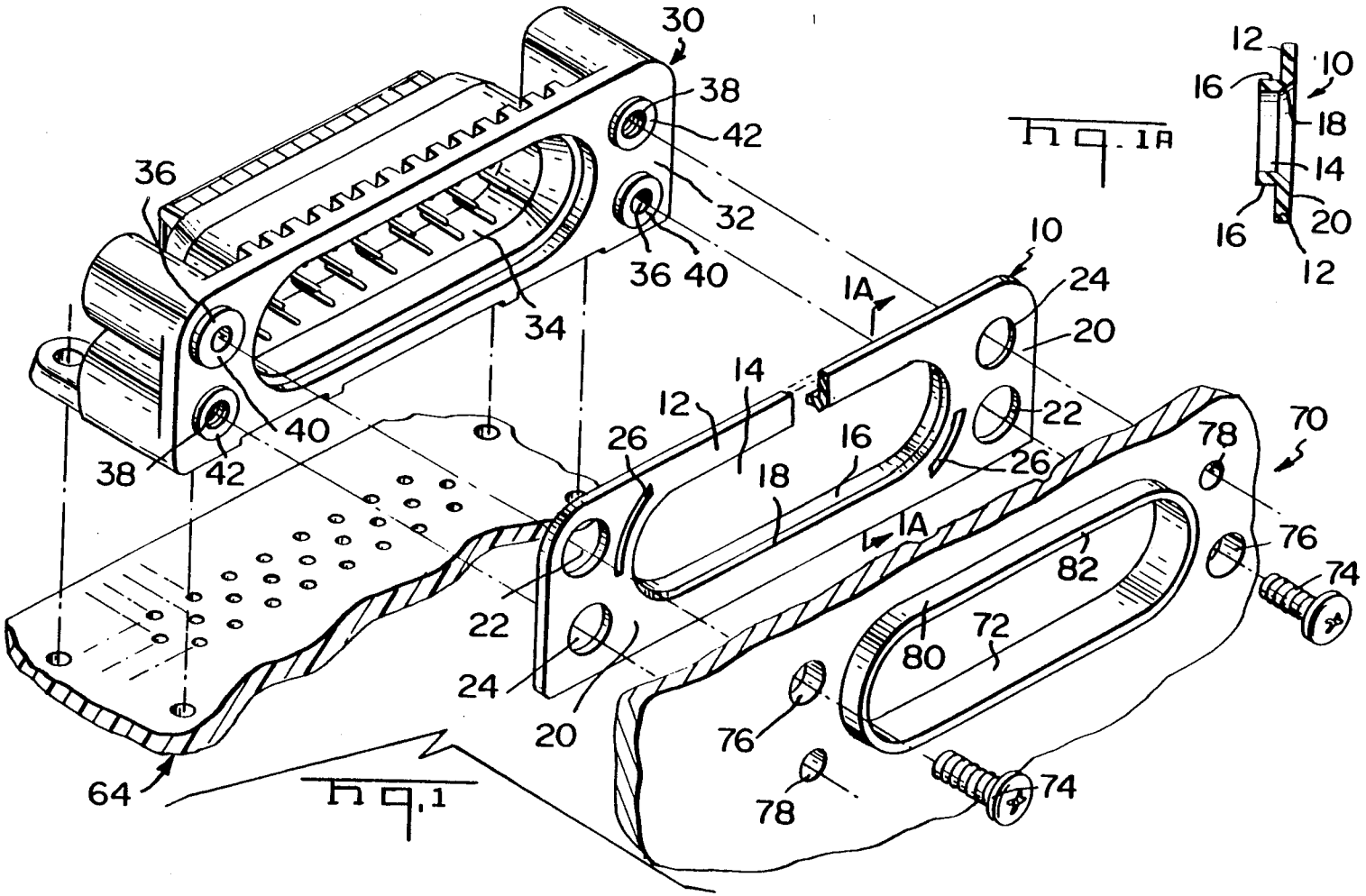
FIG. 1 is a perspective view showing the receptacle connector and the gasket seal of the present invention, the bulkhead portion and securing screws exploded therefrom, and the circuit panel to which the connector is electrically connected.
FIG. 1A is a longitudinal section view of the gasket seal taken along lines 1A—1A of FIG. 1.

Gasket seal member 10 is shown in FIG. 1 about to be assembled to a mounting face 32 of a receptacle connector 30 when connector 30 is mounted to a panel or bulkhead portion 70. Connector 30 is first secured to and in electrical engagement with printed circuit board portion 64, which is part of an automotive control "black box" (not shown). Gasket seal member 10, with reference to FIG. 1A, comprises an elastomeric article having a transverse gasket section 12 extending outwardly in a plane from the periphery of aperture 14, and an axial seal or sleeve section 16 extending rearwardly from the periphery of aperture 14. Axial seal section 16 is shown having an axial dimension about as great as its thickness, and it may be about twice as long, if desired. Preferably a beveled lead-in surface portion 18 extends around the periphery of aperture 14 at the forward face 20 of member 10. During mounting, aperture 14 is aligned with bulkhead aperture 72 and with plug-receiving cavity 34 of receptacle connector 30.

In the present embodiment receptacle connector 30 is secured to the bulkhead 70 with self-tapping screws 74 which extend through mounting holes 76 of bulkhead 70, through first holes 22 of gasket section 12 and into unthreaded screw-receiving holes 36 of connector 30 wherein they are firmly secured. Since gasket section 12 is compressed by mounting receptacle connector 30 to bulkhead 70, and the compression action is initiated at first holes 22, it is preferred to provide relief means such as slots 26 between holes 22 and aperture 14 which preserve the desired configuration at aperture 14 from deformation.

Figure 2:
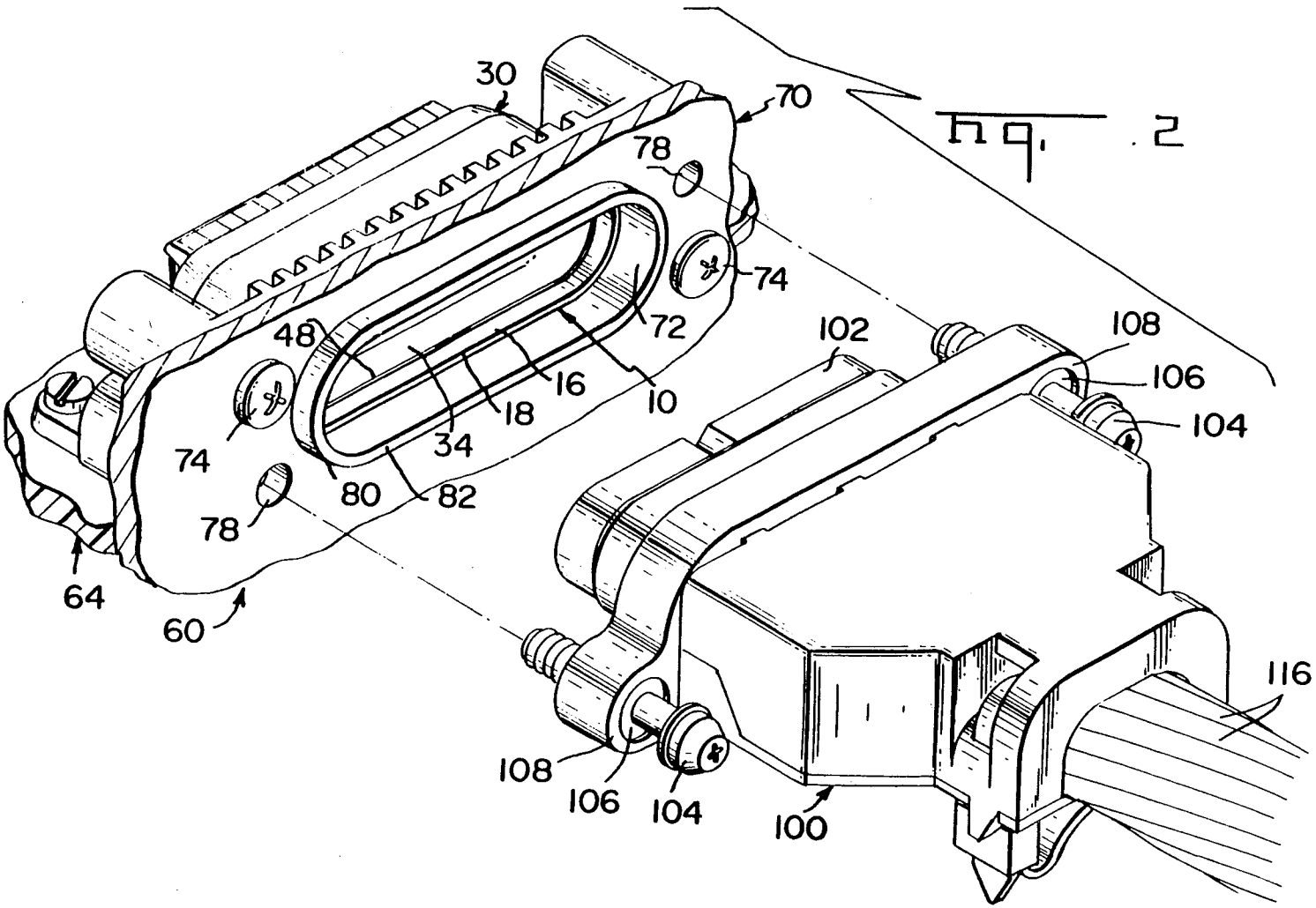
FIG. 2 is a perspective view of the receptacle connector of FIG. 1 mounted to the bulkhead, and a plug connector to be mated therewith through the bulkhead aperture.
Figure 7:
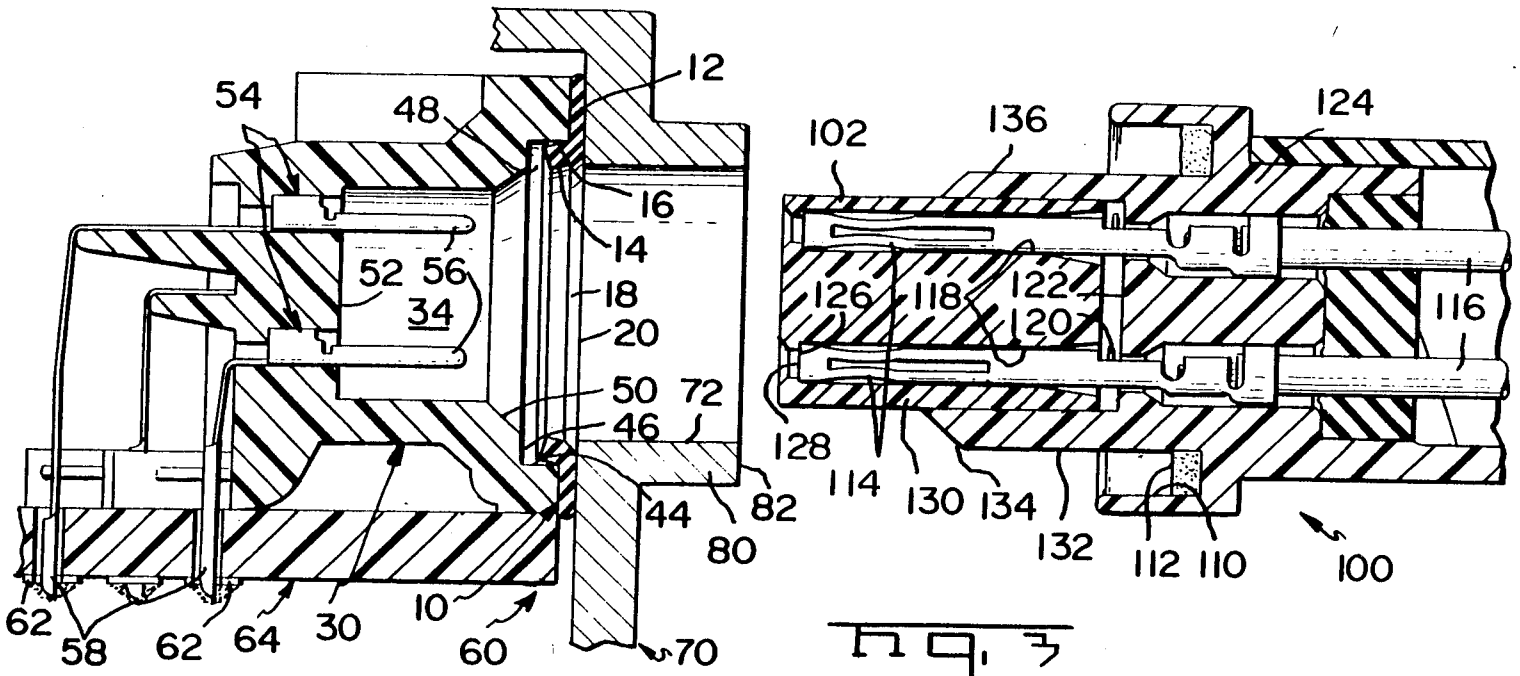

FIG. 2 shows the mounted receptacle assembly 60 ready to receive a mating plug connector 100. Plug connector 100 has a forwardly extending plug section 102 which will be inserted during mating through bulkhead aperture 72 and gasket seal aperture 14 into plug-receiving cavity 34. Plug connector 100 when fully mated with receptacle connector 30 is firmly secured to mounted receptacle assembly 60 by means such as machine screws 104 which extend through mounting holes 106 in flanges 108 of the plug connector, through corresponding holes 78 of bulkhead 70, and second holes 24 of gasket section 12 (see FIG. 1), and are securely received in threaded brass screw-receiving inserts 38 of receptacle connector 30. Insert 38 and screw-receiving holes 36 preferably have bosses 42,40 respectively, which extend through seal holes 24,22 respectively to define a precise stand-off from bulkhead 70 and avoid overcompression of gasket section 12.

The embodiments of the receptacle connector 30 and the corresponding plug connector 100 are those described more fully in U.S. patent application Ser. Nos. 876,970; 876,525; and 876,549, all filed on June 19, 1986 concurrently herewith, which are incorporated herein by reference.

Figure 4:
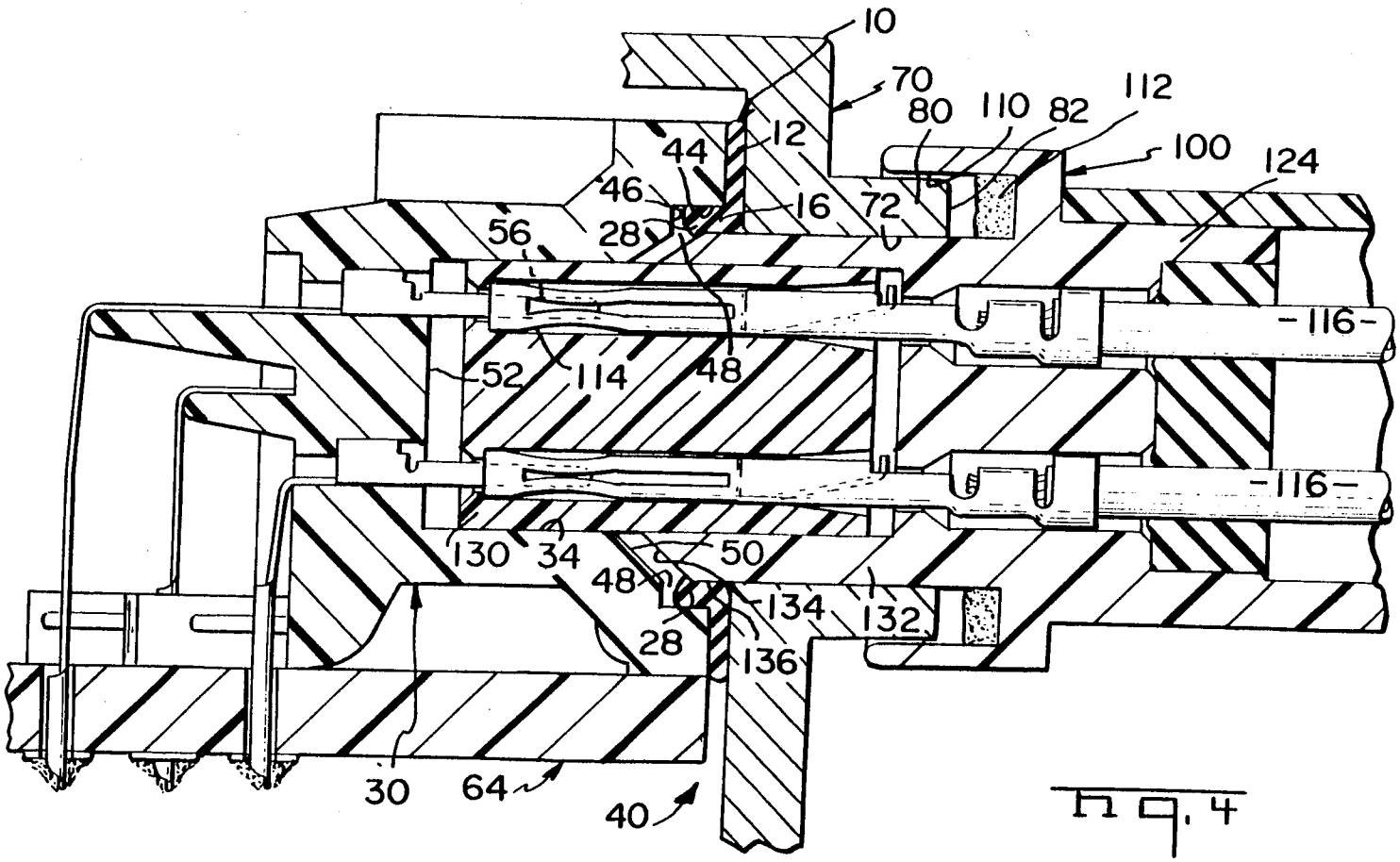
Figure 5:
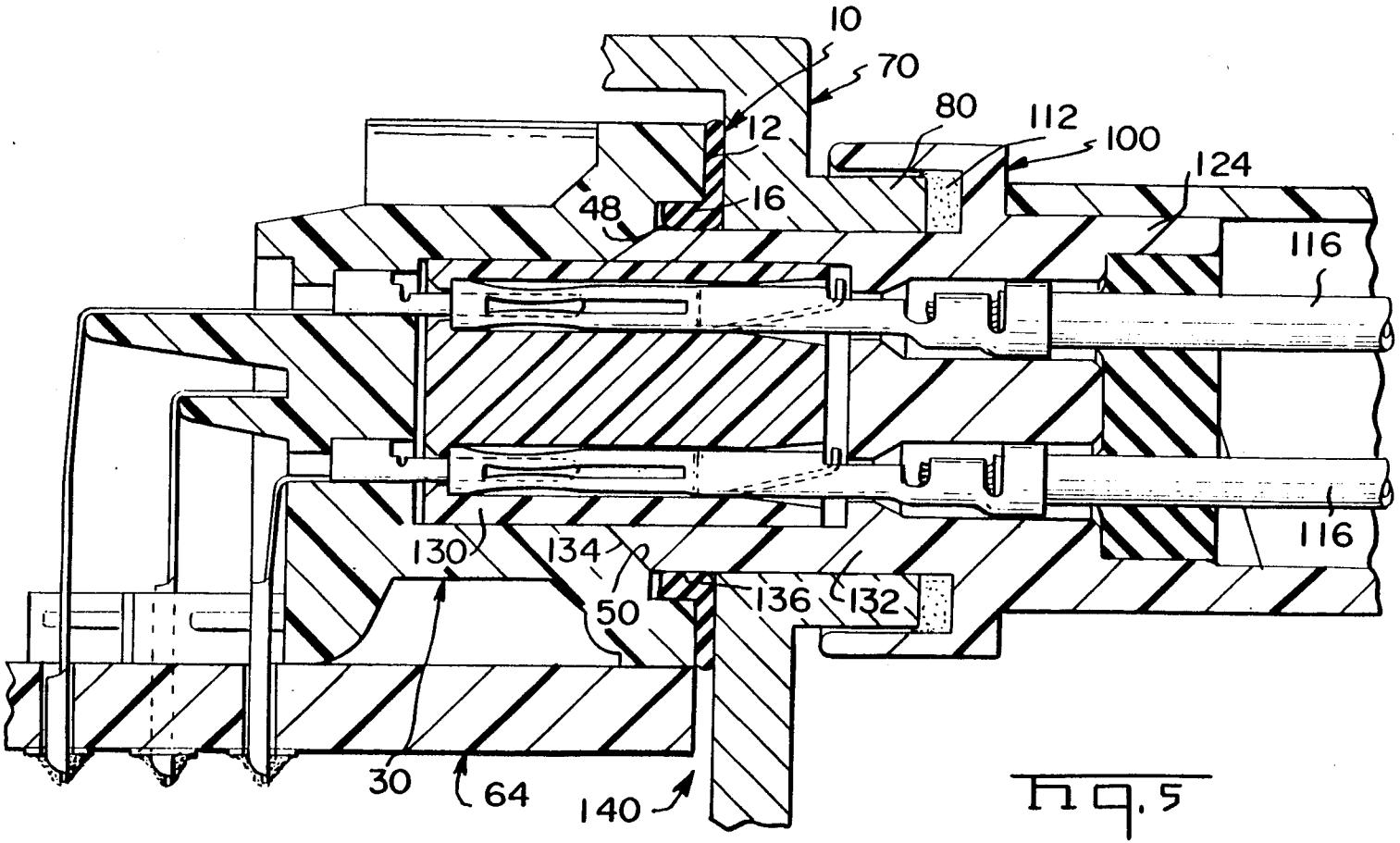

FIGS. 3, 4 and 5 illustrate the mating of plug connector 100 with receptacle connector 30 which is mounted to bulkhead 70 forming mounted receptacle assembly 60. Gasket seal member 10 is secured between receptacle connector 30 and bulkhead 70 with transverse gasket section 12 compressed therebetween, with axial seal section 16 shown tending to protrude into the forward end of the receptacle cavity 34 but which reaction does not interfere with the receipt of the plug. Beveled lead-in 18 faces forwardly towards plug 100 and will be the first portion of gasket seal 10 to be engaged by plug 100 during its insertion. Axial seal section 16 is inside and adjacent recessed wall surface 44 which extends circumferentially around the forward end of plug-receiving cavity 34. The rearward end of axial seal section 16 extends toward but is spaced from ledge 46 creating a gap 48.

A plurality of contacts 54 are secured within receptacle connector 30 and have pin sections 56 extending forwardly into cavity 34 from mating face 52 to electrically engage mating contacts of the plug connector 100; contacts 54 also have board contact sections 58 which are electrically connected to circuit paths of board 64 at connections 62 such as by soldering.

Bulkhead 70 includes a flange 80 extending circumferentially around aperture 72 and axially forwardly from bulkhead 70. Forward ends 82 thereof will be received in sealing recess 110 of plug connector 100 which has a sealing member 112 therein, preferably of foamed elastomeric material to be compressed by flange 80 to form an environmental seal when plug connector 100 is securely mounted to the bulkhead in mated engagement with the receptacle connector.

Plug connector 100 contains a plurality of socket terminals 114 each terminated to respective electrical conductors 116. The terminals are secured against rearward axial movement within passageways 118 such as by locking lances 120 extending laterally into a gap 122 between plug section 102 and a rearward section 124 of plug connector 100, and against forward movement such as by stop surfaces 126 at the forward ends of passageways 118 which are engaged by forward ends 128 of socket terminals 114.

Plug section 102 comprises a forward portion 130, a rearward portion 132 and a tapered transition portion 134. Forward portion 130 will extend into the innermost portion of plug-receiving cavity 34 of receptacle connector 30 and is dimensioned accordingly. Rearward portion 132 has a greater width and length than forward portion 130 and is dimensioned to just fit within bulkhead aperture 72. Outer or engagement surface portions 136 just rearwardly of transition portion 134 will be in sealed engagement with axial seal section 16 of gasket seal 10 upon mating.

Transition portion 134 has a tapered surface facing forwardly and outwardly and functions to engage the forward end 82 of bulkhead flange 80 and guide plug connector 100 thereinto during insertion through aperture 72. Near the forward end of the receptacle's plug receiving cavity 34 is a tapered surface portion 50 which serves as a lead-in for forward plug portion 130 and is configured to correspond with plug transition portion 134 upon full mating.

Referring to FIG. 4, plug connector 100 is partially inserted into mounted receptacle assembly 60. Pin contact sections 56 have entered socket terminals 114 and forward plug portion 130 has almost reached mating face 52 of receptacle connector 30. Bulkhead flange 80 has entered plug recess 110.

It can be seen that the dimensions and configuration of cross-section of the inside surface of axial seal section 16 of gasket seal 10 is selected to conform to the configuration of engagement surface portion 136 of plug section 102 and be slightly smaller than the dimension thereof. Tapered transition portion 134 has engaged gasket seal 10 and has begun to deform axial seal section 16 at deformations 28 rearwardly into gap 48 towards ledge 46 and also compressing it radially outwardly against recessed wall surface 44. Tapered transition portion 134 thus acts as a camming surface to initially engage gasket seal 10 and gently begin the bulk deformation thereof which is preferred for controlled deformation without risking tearing the gasket seal. Gasket section 12 which is compressed between receptacle connector 30 and bulkhead 70 holds gasket seal 10 in position during the deformation of axial seal section 16 during mating of the plug and receptacle.

FIG. 5 shows the completely mated connector assembly 140, with plug connector 100 mated with receptacle connector 30 through bulkhead 70. Gasket seal 10 seals the electrical connections from the engine environment by means of gasket section 12 and also seals against the engagement surface portion 136 of the plug connector by deformed axial seal section 16. Sealing also occurs between bulkhead flange 80 and plug connector 100 by sealing member 112.

While a short axial seal section is desirable in the present example of the gasket seal, a longer section could be useful in a gasket seal of the present invention in appropriate circumstances. The gasket seal of the present invention could have other configurations of aperture such as rectangular or circular, and could be compressed between the panel and the receptacle connector if they are fastened to each other in other ways. These and other modifications may occur which are within the spirit of the invention and the scope of the claims.

What is claimed is:

1. An integral sealing member for an electrical connector assembly, said assembly comprising a receptacle connector mounted to a panel member and a plug connector matable with the receptacle connector through an aperture in the panel member, said sealing member comprising:

a transverse gasket section having an aperture therethrough of a cross-sectional shape and dimension adapted to receive therethrough a plug section of a said plug connector, said gasket section including first holes through which means are extendable for mounting said receptacle connector to said panel, and further including relief slots each disposed intermediate one of said first holes and said aperture; and a seal section extending axially rearwardly from said gasket section at the periphery of said aperture thereof, said axial seal section having a dimension between facing inner surfaces thereof selected to be slightly less than the outer dimension of a seal-engaging surface portion of a plug section of said plug connector, whereby said gasket section seals between said panel and a forward end face of said receptacle connector mounted thereto and said axial seal section tightly and sealingly engages said seal-engaging surface portion of said plug section, during mating engagement of said plug connector in said mounted receptacle connector.

2. An integral sealing member as set forth in claim 1 wherein said gasket section includes a beveled surface portion around the periphery of said aperture at the forward face of said sealing member to initially engage said seal-engaging surface portion of said plug section of said plug connector during mating.

3. An integral sealing member as set forth in claim 1 wherein said axial seal section has an axial dimension about as great as the thickness thereof.

4. An integral sealing member as set forth in claim 1 wherein said gasket section includes second holes through which means are extendable for securing said plug connector to said mounted receptacle connector.

5. An electrical connector assembly of a plug connector, a panel means and a receptacle connector mounted to the panel means to matingly receive the plug connector, comprising:

panel means having an aperture therethrough;

a receptacle connector mounted to said panel means at said aperture, said receptacle connector including a receptacle section having a plug-receiving cavity, and a mounting face forwardly thereof proximate said panel means;

means for mounting said receptacle connector to said panel means;

a plug connector matable with said receptacle connector and including a plug section extending forwardly thereof adapted to be inserted through said panel aperture and received within said receptacle section of said receptacle connector upon mating thereof, said plug section having an outer sidewall surface including an engagement surface portion peripherally therearound; and a sealing member having a transverse gasket section having an aperture therethrough and further having an axial seal section joined integrally to said gasket section at the periphery of said seal aperture, said sealing member being disposed at a forward end of said receptacle connector, said gasket section being disposed along said mounting face and sealingly secured between said mounting face and said panel means about said panel aperture when said receptacle connector is mounted to said panel means by said mounting means, and said axial seal section extends rearwardly therefrom into said plug-receiving cavity of said receptacle connector along a forward wall portion of said cavity, said axial seal section having a cross-sectional configuration corresponding to the cross-sectional configuration of said engagement surface portion, having a selected axial dimension and having an inner dimension selected to be slightly less than the outer dimension of said engagement surface portion whereby upon mating engagement of said plug connector in said receptacle connector said engagement surface portion deforms said axial seal section outwardly against said cavity forward wall portion providing sealing for a distance therealong, and whereby said sealing member both seals between said panel means and said receptacle connector and between said receptacle connector and said plug connector.

6. An electrical connector assembly as set forth in claim 5 wherein said axial seal section of said sealing member has an axial dimension about twice as great as the thickness thereof.

7. An electrical connector assembly as set forth in claim 5 wherein said plug section has a forward portion of reduced dimension forwardly of said engagement surface portion, said plug-receiving cavity has a rearward portion of correspondingly reduced dimension from said forward wall portion and defining a forwardly facing ledge therebetween, and said axial seal section of said sealing member is disposed forwardly of said ledge and spaced therefrom.

8. An electrical connector assembly as set forth in claim 7 wherein said plug section has a tapered transition portion between said forward plug portion and said engagement surface portion and said plug-receiving cavity has a correspondingly tapered transition portion extending rearwardly from said ledge to said rearward cavity portion, whereby said cavity transition portion provides a lead-in for said forward plug portion, and said plug transition portion provides a camming surface for gently engaging said axial seal section of said sealing member and deforming it outwardly, during mating engagement of said plug connector in said receptacle connector.

9. An electrical connector assembly as set forth in claim 5 wherein said mounting means comprises first screw means extending through first holes in said panel means and corresponding first holes through said sealing member and into engagement with cooperating first screw-receiving means of said receptacle connector.

10. An electrical connector assembly as set forth in claim 9 wherein said gasket section of said sealing member includes relief means each disposed intermediate one of said first holes and said seal aperture to protect the cross-sectional configuration of said seal aperture from deformation upon compression of said gasket section proximate said first holes during mounting of said receptacle connector to said panel means.

11. An electrical connector assembly as set forth in claim 5 further comprising means securing said plug connector to said mounted receptacle connector when mated, said securing means comprising second screw means extending through holes in flange means of said plug connector and through corresponding second holes in said panel means and corresponding second holes through said sealing member, and into engagement with cooperating second screw-receiving means of said receptacle connector.

12. An electrical connector assembly as set forth in claim 5 wherein said gasket section of said sealing member includes a beveled surface portion around the periphery of said seal aperture at the forward face of said sealing member to initially engage said engagement surface portion of said plug section of said plug connector during mating.

13. An electrical connector assembly of a receptacle connector mounted to a panel means to matingly receive a plug connector, the plug connector having a plug section with outwardly facing side walls peripherally therearound comprising:

panel means having an aperture therethrough;

a receptacle connector mounted to said panel means at said aperture, said receptacle connector including a receptacle section having a cavity adapted to receive thereinto said plug section of said plug connector, and a mounting face forwardly thereof proximate said panel means;

means for mounting said receptacle connector to said panel means; and a sealing member having a transverse gasket section having an aperture therethrough and further having an axial seal section joined integrally to said gasket section at the periphery of said seal aperture, said sealing member being disposed at a forward end of said receptacle connector, said gasket section being disposed along said mounting face and sealingly secured between said mounting face and said panel means about said panel aperture when said receptacle connector is mounted to said panel means by said mounting means, and said axial seal section extends rearwardly therefrom into said plug-receiving cavity of said receptacle connector along a forward wall portion of said cavity, said axial seal section having a cross-sectional configuration corresponding to the cross-sectional configuration of a seal-engaging surface portion of said outwardly facing side walls of said plug section, having a selected axial dimension and having an inner dimension selected to be slightly less than the outer dimension of said seal-engaging surface portion whereby upon mating engagement of said plug connector in said receptacle connector said seal-engaging surface portion deforms said axial seal section outwardly against said cavity forward wall portion providing sealing for a distance therealong, and whereby said sealing member both seals between said panel means and said receptacle connector and between said receptacle connector and said plug connector.

14. An electrical connector assembly as set forth in claim 13 wherein said axial seal section of said sealing member has an axial dimension about as great as the thickness thereof.

15. An electrical connector assembly as set forth in claim 13 wherein said plug-receiving cavity has a rearward portion of reduced dimension from said forward wall portion and defining a forwardly facing ledge therebetween, and said axial seal section of said sealing member is disposed forwardly of said ledge.

16. An electrical connector assembly as set forth in claim 13 wherein said mounting means comprises first screw means extending through first holes in said panel means and corresponding first holes through said sealing member and into engagement with cooperating first screw-receiving means of said receptacle connector.

17. An electrical connector assembly as set forth in claim 16 wherein said gasket section of said sealing member includes relief means each disposed intermediate one of said corresponding first holes and said seal aperture to protect the cross-sectional configuration of said seal aperture from deformation upon compression of said gasket section proximate said corresponding first holes during mounting of said receptacle connector to said panel means.

18. An electrical connector assembly as set forth in claim 13 wherein said gasket section of said sealing member includes a beveled surface portion around the periphery of said seal aperture at the forward face of said sealing member to initially engage said seal-engaging surface portion of said plug section of said plug connector during mating.

* * * * *